United States Patent [19]

Vizelyi et al.

[11] 3,943,327

[45] Mar. 9, 1976

[54] CIGARETTE DISPENSER AND AN ELECTRIC LIGHTER

[76] Inventors: Gabor Vizelyi, 330 Michigan Ave., Miami Beach, Fla. 33139; Bela Meszaros, 9205 Byron Ave., Surfside, Miami Beach, Fla. 33154

[22] Filed: Dec. 18, 1974

[21] Appl. No.: 534,140

[52] U.S. Cl. ..... 219/261; 219/262; 219/267; 221/147; 312/86

[51] Int. Cl.[2] ..... F23Q 7/00

[58] Field of Search ..... 219/214, 260, 261, 262, 219/263, 266, 267, 268; 55/385; 312/86; 221/147

[56] References Cited

UNITED STATES PATENTS

| | | | |
|---|---|---|---|
| 1,370,631 | 3/1921 | Clark | 219/261 |
| 1,608,615 | 11/1926 | Pengilly | 219/261 |
| 1,990,856 | 2/1935 | Claggett | 219/214 X |
| 2,132,771 | 10/1938 | Aronson | 219/261 |
| 3,351,735 | 11/1967 | Desbiens | 219/261 |
| 3,361,894 | 1/1968 | Lester | 219/261 |
| 3,516,232 | 6/1970 | Gilbertson | 55/385 |
| 3,548,148 | 12/1970 | Kawasima | 219/262 |
| 3,705,414 | 12/1972 | Senkewich | 219/262 |
| 3,769,492 | 10/1973 | Senkewich | 219/262 |
| 3,789,187 | 1/1974 | Brezina | 219/261 |

*Primary Examiner*—Volodymyr Y. Mayewsky
*Attorney, Agent, or Firm*—Clarence A. O'Brien; Harvey B. Jacobson

[57] ABSTRACT

A housing is provided including an upper portion for storing a plurality of cigarettes and a lower portion including cigarette support and ignition structure for supporting and igniting a cigarette dispensed thereto by gravity from the upper portion. The upper portion includes cigarette dispensing structure for dispensing single cigarettes downwardly by gravity toward the support and ignition structure. The cigarette support and ignition structure is of a construction to support a cigarette to be ignited in an inclined position and includes an electrical resistance heating element positioned for end abutting engagement of the lower end of the supported cigarette to be ignited, whereby the lower end of the cigarette will be ignited upon actuation of the electrical resistance heating element. The housing includes an upstanding side wall portion having an opening formed therethrough and the opening is positioned in relation to the cigarette support and ignition structure whereby a cigarette supported therefrom for ignition will have the upper end thereof disposed in a position projecting through the opening. In this manner, the ignited cigarette may be readily lengthwise extracted from the cigarette dispenser.

3 Claims, 7 Drawing Figures

CIGARETTE DISPENSER AND AN ELECTRIC LIGHTER

BACKGROUND OF THE INVENTION

There have, heretofore, been various types of cigarette dispensing and igniting structures heretofore designed. Some of these previous structures may be found in U.S. Pat. Nos. 1,370,631, 1,608,615, 2,132,771, 3,351,735 and 3,361,894.

The previously patented structures for igniting cigarettes are reasonably simple in construction, but most previously patented dispensers for cigarettes including cigarette ignition means are complex in structure and thus expensive and subject to malfunctions. In addition, most cigarette dispensers, whether or not provided with cigarette ignition means, are constructed in a manner whereby the dispensed cigarette is dispensed by gravity to a horizontal support station from which the dispensed cigarette may be withdrawn by grasping the central portion of the cigarette between two fingers. However, in order to provide relatively simple cigarette ignition structure for use in conjunction with a cigarette dispenser, the cigarette to be ignited may not be disposed in a horizontal position. When one end of a horizontally disposed cigarette is horizontally registered with an electrical resistance heating element initial partial ignition of the end of the cigarette adjacent the electrical resistance heating element increases the spacing between the material to be ignited and the heating element with the result that only partial ignition of the cigarette is accomplished, at least in some cases.

BRIEF DESCRIPTION OF THE INVENTION

The dispenser of the instant invention includes an upper hopper portion in which a plurality of cigarettes may be stored in horizontal position and the lower portion of the hopper includes dispensing means for singly downwardly dispensing cigarettes by gravity to a lower support and ignition structure for the dispensed cigarette. However, the support and ignition structure is of a configuration to support the cigarette to be ignited in an inclined position with the lower end thereof end abutted against an electrical resistance heating element. In this manner, initial ignition of the end of the cigarette abutted against the electrical resistance heating element does not create a spacing between the cigarette and the heating element inasmuch as the cigarette is free to slide downwardly on the support surface provided therefor toward the electrical resistance heating element. Therefore, the lower end of a cigarette to be ignited is fully ignited by the electrical resistance heating element.

In addition, the housing of the cigarette dispenser is constructed in a manner whereby an upstanding wall portion thereof having an opening formed therein is positioned in relation to the support structure for a cigarette to be ignited such that the upper end of a cigarette being ignited will project through the opening in the side wall of the housing, thus exposing the end of the cigarette farthest from the ignited end thereof for grasping by the user of the dispenser to lengthwise withdraw the ignited cigarette. Accordingly, the cigarette dispenser of the instant invention is constructed in a manner to more efficiently ignite the end of the cigarette to be ignited and to provide maximum safety for the user of the dispenser whereby it will be substantially impossible for the user to have any portion of his hand or fingers come in contact with either the electrical resistance heating element, a closely adjacent portion of a covering shield portion of the electrical resistance heating element or the ignited end of the cigarette, even should the person actuate the dispenser and attempt to withdraw an ignited cigarette therefrom without looking at the dispenser.

The main object of this invention is to provide a cigarette dispenser which will be capable of singly dispensing cigarettes. A further object of this invention is to provide a cigarette dispenser including ignition means for automatically igniting each cigarette which is dispensed from the dispenser.

Another object of this invention, in accordance with the immediately preceding object, is to provide ignition means for the cigarette dispensed which is completely housed within a housing and thereby protected against contact by the user's hand or fingers.

Still another important object of this invention is to provide a cigarette dispenser which will support the dispensed and ignited cigarette in an inclined position with the ignited end of the cigarette lowermost within the housing and the upper end of the cigarette projecting slightly through a horizontal opening formed in one upstanding wall portion of the housing of the dispenser.

A final object to be specifically enumerated herein is to provide a lighted cigarette dispenser in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
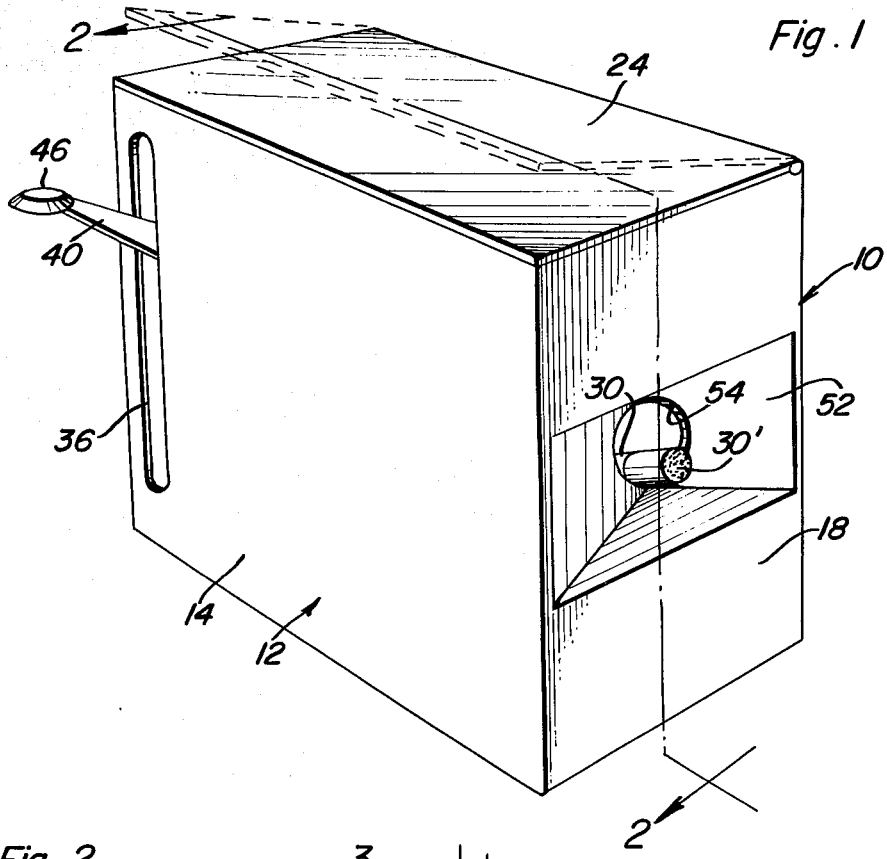
FIG. 1 is a perspective view of the lighted cigarette dispenser of the instant invention.

The numeral 10 generally designates the lighted cigarette dispenser of the instant invention. The dispenser 10 includes an upstanding housing referred to in general by the reference numeral 12 including opposite side walls 14 and 16, opposite end walls 18 and 20, a bottom wall 22 extending between and interconnecting the walls 14, 16, 18 and 20 and a hinged top wall 24 pivotally supported from the upper marginal edge portion of the side wall 16 as at 26.

The interior of the housing 12 includes an upper portion having a hopper type support structure 28 supported therein and into which cigarettes 30 to be housed within the housing 12 may be downwardly displaced for support from the hopper type support structure 28 through the open top of the housing 12 when the top wall 24 is in an open position.

A partial cylindrical dispensing drum 32 having one open side extends between and is journaled from the end walls 18 and 20 and the end of the drum 32 adjacent the end wall 20 has a gear wheel 34 mounted thereon.

The side wall 14 has a vertically extending slot 26 formed therein closely adjacent the end wall 20 and the base end 38 of an operating lever 40 is pivotally supported within the housing 12 adjacent the side wall 16 as at 42. The free end portion 44 of the lever 40 is slidingly received within the slot 36 and terminates in a horizontally enlarged finger-engageable abutment 46 for digital manipulation of the lever 40 from the exterior of the housing 12.

Figure 3:
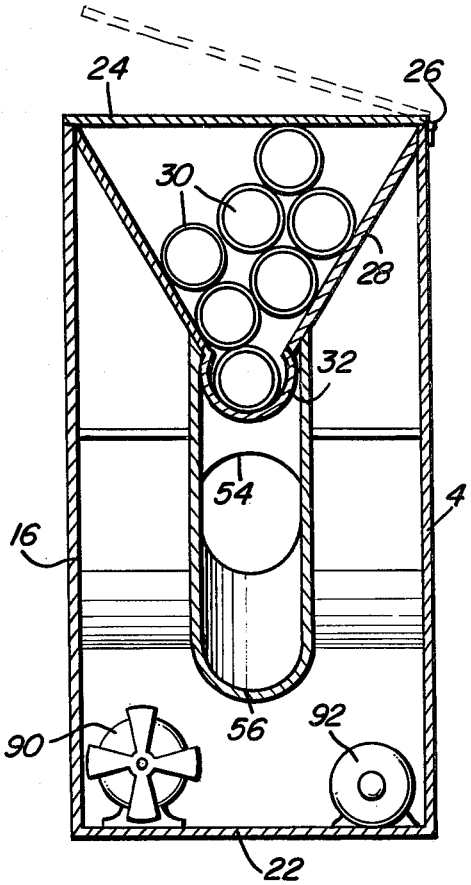
FIG. 3 is a transverse vertical sectional view taken substantially upon the plane indicated by the section line 3—3 of FIG. 2 and with the top wall portion of the housing illustrated in a partially open position by phantom lines.
Figure 6:
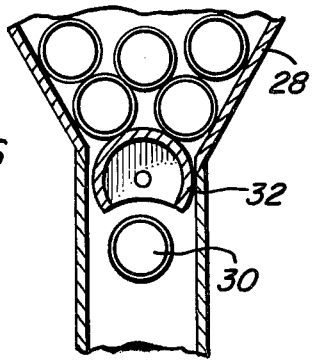
FIG. 6 is a fragmentary transverse vertical sectional view similar to the upper central portion of FIG. 3 but with the cigarette dispensing cylinder of the dispenser in a cigarette dispensing position.
Figure 7:
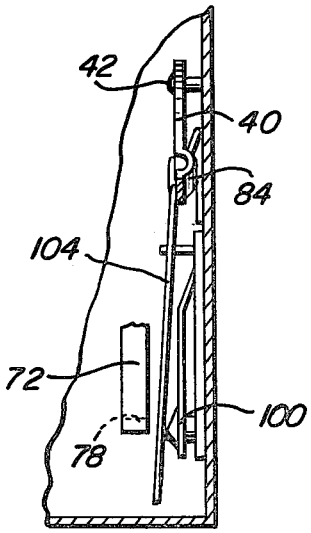
FIG. 7 is a fragmentary vertical sectional view similar to the lower right-hand portion of FIG. 2 but illustrating the contact switch of the actuating electrical circuit of the dispenser in a closed position.

The mid-portion of the lever 40 has an intermediate portion of an upstanding rack gear 48 pivotally supported therefrom as at 50. The rack gear 48 is registered and meshed with the gear wheel 34 and any suitable means such as an expansion spring or internal guides within the housing 12 may be provided to maintain the rack gear 48 in meshed engagement with the gear wheel 34. In any event, as the free end portion 44 of the lever 40 is downwardly depressed from the solid line position thereof illustrated in FIG. 4 of the drawings to the phantom line position shown in FIG. 4, the drum 32 is rotated from the upwardly opening position thereof illustrated in FIGS. 3 and 4 for the reception of the lowermost cigarette 30 within the hopper-type support structure 28 therein to a downwardly opening position such as that illustrated in FIG. 6 whereby the cigarette 30 previously disposed within the drum 32 will be free to fall by gravity into the lower portion of the housing 12.

Figure 2:
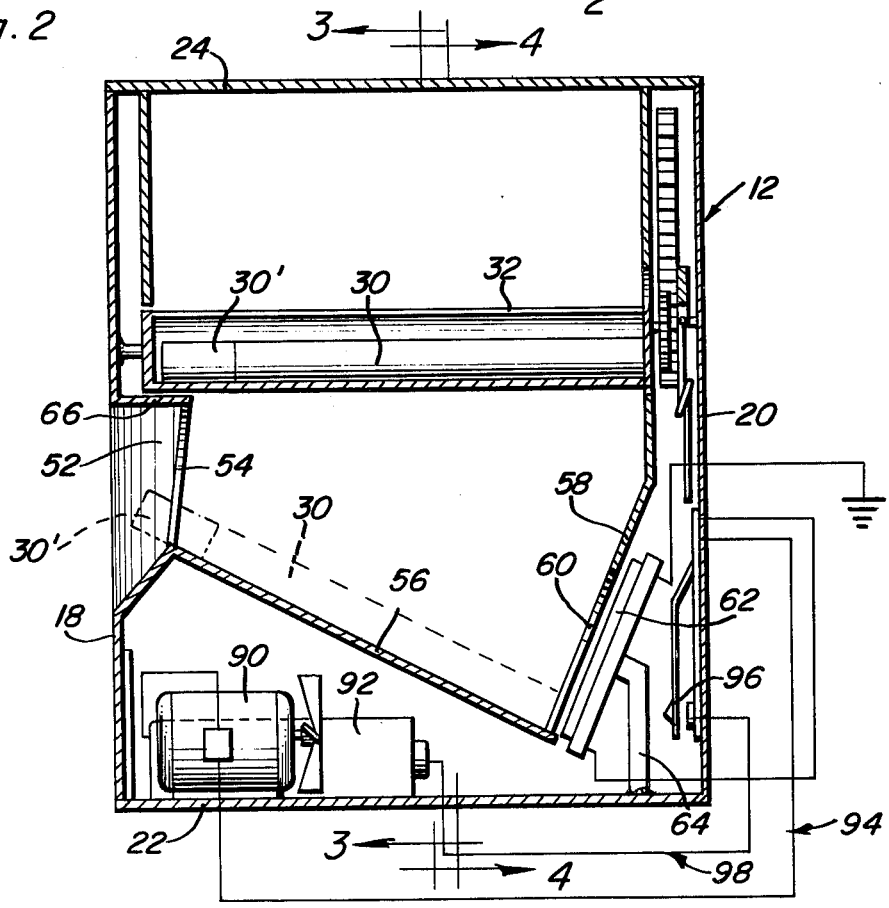
FIG. 2 is a vertical sectional view taken substantially upon the plane indicated by the section line 2—2 of FIG. 1 and including a diagrammatic illustration of the electrical circuitry of the dispenser.

The end wall 18 of the housing 12 includes an inwardly recessed portion 52 having a horizontal opening 54 formed therethrough and supported within the lower portion of the housing 12 is a U-shaped support cradle 56. The cradle 56 is downwardly inclined toward the lower end of the end wall 20 and is closed at its lower end by means of an inclined end wall portion 58 disposed at substantially right angles to the longitudinal extent of the support trough or cradle 56. The wall 58 has an opening 60 formed therein and an electrical resistance heating element 62 is supported, by means of a support structure 64, in registry with the outer end of the opening 60. The inwardly recessed or offset wall portion 52 is joined to the vertical portion of the wall 18 immediately thereabove by means of a horizontal flange portion 66 and it will be noted that the innermost portion of the horizontal flange portion 66 is in registry with the lower portion of the drum 32 opposing the end wall 18. Accordingly, as the drum 32 is rotated from the positions thereof illustrated in FIGS. 3 and 4 of the drawings to the position thereof illustrated in FIG. 6 in order to downwardly dispense the cigarette 30 previously resting within the drum 32, the filter end 30' (see FIG. 2) of the cigarette 30 strikes the upper surface of the flange portion 66 and is therefore retarded in its downward falling movement until such time as the remote end of the cigarette 30 falls downwardly into contact with the end wall 58 and thereafter slides down the latter for reception through the opening 60 and endwise abutted engagement with the heating element 62. As the end of the cigarette 30 remote from the filter 30' is received in the lower portion of the opening 60, the filter end 30' of the cigarette 30 slides out of contact with the inner end of the flange portion 66 and swings downwardly to the position thereof illustrated by phantom lines in FIG. 2 with the filter end 30' of the cigarette 30 projecting outwardly through the opening 54.

A latch construction referred to in general by the reference numeral 68 is provided and includes a horizontal arm portion 70 and a vertical arm portion 72. The horizontal arm portion 70 includes a base end 74 anchored to the side wall 16 as at 76 and a free end portion 78 supported from the base end portion 76 by means of a connecting sleeve 80 having a high coefficient of expansion. The upper end of the vertical arm portion 72 includes a latching lug 82 and the latching lug 82 is cammed out of registry by the lever 40 upon its downward movement to the phantom line position thereof illustrated in FIG. 4 and is then engageable over the upper surface of the lever 40 to retain the latter in its downwardly displaced position against the biasing action of the spring 86, see FIG. 4, connected between the housing side wall 16 and the lever 44 to upwardly displace the latter toward its solid line position of FIG. 4.

Figure 4:
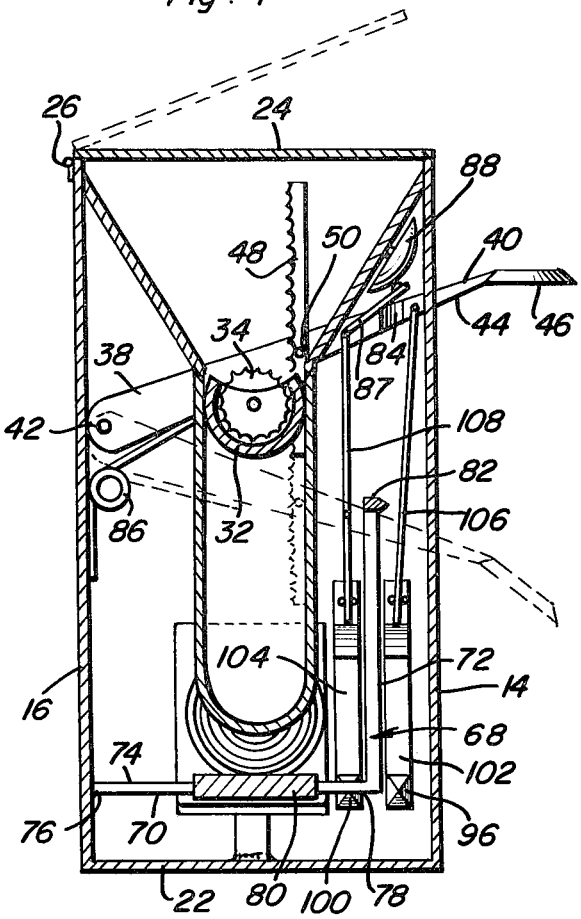
FIG. 4 is a transverse vertical sectional view taken substantially upon the plane indicated by the section line 4—4 of FIG. 2 and with an alternate downwardly displaced position of the actuating lever of the dispenser illustrated in phantom lines.
Figure 5:
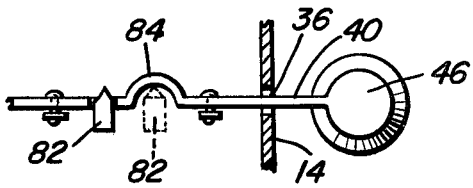
FIG. 5 is a fragmentary horizontal sectional view illustrating the manner in which the actuating lever is held in a downwardly displaced position by means of a latch construction in the applied position and automatically shiftable, in response to a rise in ambient heat, to an inoperative position for release of the actuating lever.

From FIG. 4 of the drawings it may be seen that the connecting sleeve is positioned to be heated by radiant heat energy from the heating element 62 upon actuation of the latter. When the connecting sleeve 80 is heated it increases in effective length and the lug 82 is shifted from the solid line position thereof illustrated in FIG. 5 to the phantom line position thereof illustrated in FIG. 5 in registry with a bowed portion 84 of the lever 40 whereby the lever 40 will be released for upward movement under the biasing action of the spring 86. The lever 40 includes a resilient clapper arm 86 supported therefrom and the hopper type support structure includes a bell gong 88 engageable by the clapper arm 87 upon rapid upward movement of the lever 40 under the biasing action of the spring 86 to the phantom line position of the lever 40 illustrated in FIG. 4.

An electric blower 90 is mounted within the lower portion of the housing 12 and is electrically connected to a source 92 of electrical potential by means of a wiring circuit 94 having an insulatively mounted spring contact 96 electrically connected therein. Also, the electrical resistance heating element 62 is insulatively mounted and electrically connected to the source 92 by means of an electrical circuit 98 having an insulatively supported contact 100 serially connected therein. A pair of contact engaging slides 102 and 104 are insulatively slidably supported within the housing 12 for vertical reciprocation therein and are connected to the mid-portion of the lever 40 on opposite sides of the bowed portion 84 by means of connecting rods 106 and 108, respectively. Accordingly, upon downward movement of the lever 40 from the solid line position thereof illustrated in FIG. 4 to the phantom line position of FIG. 4 the slides 102 and 104 are displaced downwardly to close the spring contacts 96 and 100 and thereby electrically connect the blower 90 and the electrical resistance heating element 62 to the source 92 as the cigarette within the dispensing drum 32 is downwardly displaced therefrom from the solid line position thereof illustrated in FIG. 2 within the dispensing drum 32 to the phantom line position thereof illustrated in FIG. 2 resting in the support trough or cradle 56 with the lower end of the cigarette 30 abutted against the electrical resistance heating element 62. Of course, contact of the lower end of the cigarette 30 with the electrical resistance heating element 62 and the air circulating action created by the blower 90, the lower end of the cigarette 30 supported within the support trough or cradle 56 is fully ignited. However, during operation of the electrical resistance heating element 62 to ignite the lower end of the cigarette 30, the sleeve 80 is heated and thus caused to expand and to thereby shift the lug 82 carried by the upper end of the vertical arm portion 72 from the solid line position thereof illustrated in FIG. 5 to the phantom line position thereof illustrated in FIG. 5, whereby the lever 40 is free to swing upwardly from the phantom line position thereof illustrated in FIG. 4 to the solid line position of FIG. 4 under the biasing action of the spring 86. Upward movement of the lever 40 to the solid line position of FIG. 4 upwardly withdraws the slides 102 and 104 from the spring contacts 96 and 100 and thereby opens the circuit 94 and 98 to the blower 90 and electrical resistance heating element 62.

As hereinbefore set forth, after the cigarette 30 has been downwardly displaced to its position supported from the support trough or cradle 56, the filter tip end 30' thereof projects outwardly through the opening 54 whereby the filter tip end 30' of the cigarette 30 may be readily grasped after being ignited in the manner above set forth and return of the lever 40 to the upper phantom line position thereof illustrated in FIG. 4 has been accomplished in order to sound the bell gong 88 signalling that the cigarette 30 is ready to be withdrawn from the support trough or cradle 56 through the opening 54.

The foregoing is considered as illustrative only of the principles of the invention. Further, since numerous modifications and changes will readily occur to those skilled in the art, it is not desired to limit the invention to the exct construction and operation shown and described, and accordingly all suitable modifications and equivalents may be resorted to, falling within the scope of the invention.

What is claimed as new is as follows:

1. A lighted cigarette dispenser including a support housing including an upper portion for storing a plurality of cigarettes in horizontal position and a lower portion including first means for catching and supporting a cigarette dispensed theretoward by gravity from said upper portion, said upper portion including second means for dispensing single horizontal cigarettes downwardly from said upper portion by gravity toward said support means, said first means including means for supporting a dispensed cigarette in an inclined position, said housing including abutment means therein below said dispensing means for abutment by one terminal end of a cigarette downwardly dispensed from said second means to check the descent of said one terminal end and thereby cause the cigarette to be angularly displaced to an inclined position for catching by and support from said first means, an upstanding side wall portion having an opening formed therethrough closely beneath said abutment means, said opening being positioned in relation to said first means whereby an inclined cigarette supported from said first means will have the upper end thereof disposed in a position projecting through said opening, said upper portion defining an upwardly opening elongated storage hopper including downwardly convergent lower wall portions spaced apart at their lower ends, said second means comprising a generally horizontal cylindrical dispensing drum journalled between said lower wall portions and having one open side for the reception of a single cigarette therein from said hopper when said open side faces upwardly, said second means including an operator shiftable between active and inactive positions, said first means including electrical resistance heating element means comprising an abutment for engagement by the lower end of a supported cigarette, electrical switch means for said electrical resistance heating element and for serial connection in a circuit in which said resistance heating element is also serially connected, said operator and switch means including coacting means operative to close and open said switch means in response to shifting of said operator between said active and inactive positions, said operator being drivingly connected to said drum for oscillating the latter approximately 180 degrees in response to movement of said operator from said inactive position, to said active position and then back to said inactive position.

2. The combination of claim 1 including latch means operatively associated with said operator for automatically retaining said operator in said active position, means yieldingly biasing said operator toward said inactive position, said latch means including heat responsive means operative to an increase of ambient temperature for rendering said latch means ineffective to retain said operator in said active position, said heat responsive means being orientated relative to said resistance heating element to be heated thereby.

3. The combination of claim 2 wherein said dispenser includes electrically driven blower means in said housing electrically associated with said resistance heating means for actuation of the former in response to actuation of the latter.

* * * * *